United States Patent [19]

Corsette

[11] 4,050,613

[45] Sept. 27, 1977

[54] MANUAL ACTUATED DISPENSING PUMP

[76] Inventor: Douglas F. Corsette, 6559 Firebrand St., Los Angeles, Calif. 90045

[21] Appl. No.: 719,236

[22] Filed: Aug. 31, 1976

[51] Int. Cl.[2] ..... B05B 11/00; B65D 47/34

[52] U.S. Cl. ..... 222/321; 222/383; 239/333; 239/350

[58] Field of Search ..... 222/321, 383, 385; 239/320, 321, 322, 333, 350

[56] References Cited

U.S. PATENT DOCUMENTS

| | | | |
|---|---|---|---|
| 3,257,961 | 6/1966 | Schlenker | 222/321 X |
| 3,399,836 | 9/1968 | Pechstein | 222/321 X |
| 3,921,861 | 11/1975 | Kondo | 239/333 X |
| 3,949,906 | 4/1976 | Pettersen et al. | 239/333 X |

*Primary Examiner*—Robert B. Reeves
*Assistant Examiner*—David A. Scherbel

[57] ABSTRACT

A dispensing pump of the type in which the discharge valve will open and will remain open only for such time as the pumping pressure is maintained above a predetermined minimum. The pump includes a unitary plunger unit of annular configuration, the inner-periphery of which cooperates with the pump piston to provide the main pump chamber, while its outer periphery cooperates with a socketed plunger head in the manner of a piston, to provide therewith a variable volume pressure accumulation chamber and to function as a pressure actuated discharge valve and shipping seal as well as a vent seal.

12 Claims, 5 Drawing Figures

MANUAL ACTUATED DISPENSING PUMP

This invention relates to improvements in pressure accumulation type dispensing pumps in which the pump discharge pressure is required to be maintained at or above a predetermined minimum in order to open and maintain the discharge valve in its open position. Such pumps have found their primary utility in connection with spray discharge devices in which the discharge pressure must be at a predetermined minimum in order to achieve efficiency of the spraying action.

Pressure accumulating dispensing pumps of the type above generally described are well known in the prior art, being exemplified for instance by such prior U.S. patents as Pechstein U.S. Pat. No. Re. 28,366, Boris U.S. Pat. No. 3,746,260, Nozawa et al. U.S. Pat. No. 3,908,870, Kondo U.S. Pat. No. 3,921,861 and various of the prior art patents cited in each of said patents.

The prior art employed separate but interconnected pistons of different diameters within separate pump chambers communicating with each other in such a way that flowable product pumped by a first piston within the first such cylinder was temporarily stored under pressure within a pressure accumulation cylinder or chamber in which the second piston works, and was required to displace that piston against the action of a biasing spring sufficiently to open a discharge valve connected to the second piston. It will be apparent that such structures require numerous parts and assembly operations with consequent expense of fabrication.

It is a primary object of the present invention to produce a dispensing pump of the pressure accumulating type which is capable of fabrication from a minimum number of unitary parts by a minimum number of assembly operations.

More particularly a dispensing pump in accordance with the present invention requires but three major components or units in addition to a conventional pump spring and dip-tube. Such units are movable with respect to each other under the application of intermittent finger pressure, for achieving the necessary pumping, valving and venting functions including control of the discharge pressure of the product. Both the pumping and venting action are achieved by reciprocation of the plunger unit with respect to the pump body unit and its included stationary piston unit. Control of the outlet valving function is achieved through relative movement between the plunger and plunger head units in response to changes in fluid pressure within a pressure accumulation chamber jointly defined by those units in free communication with the pump chamber. The plunger itself functions as an outlet valve and eliminates the need for a separate or more conventional type of outlet valve.

In summation, the invention is characterized by the unitary plunger unit which, in cooperation with other components performs the multiple functions of: a pump cylinder; a piston for the pressure accumulation chamber; a pressure actuated discharge valve and shipping seal and, if desired, a vent seal and intake valve (where the latter is formed as a unitary portion of the plunger unit).

BRIEF SUMMARY OF THE INVENTION

In accordance with the invention there is provided a pump body unit and means for fixing it over an outlet opening of a conventional container. The body unit includes a piston affixed to and projecting upwardly therefrom. An annular or tubular plunger unit is mounted for reciprocation on the piston to therewith define a variable volume pump chamber, and a plunger spring urges the plunger unit upwardly toward a fully raised position within the variable volume pump chamber. The body unit has a check valve controlled inlet passage therethrough and through the piston communicating with the pump chamber to place the latter in communication with the container of flowable product to be dispensed by the pump. A plunger head unit having a downwardly directed blind socket is snugly slidably disposed on the tubular plunger unit and therewith defines a variable volume accumulation chamber above the plunger communicating freely with the pump chamber and inlet passage. The plunger head unit is conformed to receive intermittent downwardly directed finger pressure in opposition to the pressure of the spring and means are provided for arresting the upward movement of the plunger head, so that the plunger unit will be fully raised to the upper end of the plunger head socket by its spring to close a discharge passage opening through the wall of the plunger head from the pressure accumulation chamber to a discharge orifice of opening in communication with the atmosphere.

In a specific preferred embodiment of pump, the discharge orifice is defined by a spray nozzle which includes a swirl chamber arranged concentrically to the discharge orifice. The swirl chamber is jointly defined by and between the plunger unit and plunger head unit so that relative movement between these units agitates and removes any coagulated or precipitated solids that might otherwise tend to accumulate in and clog the spray nozzle. Such accumulation is further discouraged by the close proximity between the plunger and discharge orifice.

DESCRIPTION OF THE FIGURES OF DRAWINGS

The presently preferred embodiment of the invention is illustrated in the accompanying drawings in which:

FIG. 1, is a cross sectional view in a vertical radial plane through a dispensing pump incorporating the features of the invention, the same being illustrated with a removable protective overcap applied thereto. The pump components in this view are illustrated in their normal position of rest or disuse in which all valves are closed to prevent leakage of product in the event of tipping or inversion of a filled product container to which the pump is applied.

FIG. 2, is a view similar to FIG. 1, in which the components are illustrated in the relative positions which they will assume substantially mid-way of the discharge stroke of the plunger and plunger head, with the inlet valve closed and the discharge valve open, the vent at this time being in communication with the atmosphere. In this view for purposes of simplification, the overcap has been omitted.

FIG. 3, is a view similar to FIGS. 1 and 2, illustrating the various pump units or components in the positions assumed by them mid-way of the suction or intake stroke of the plunger and plunger head, the inlet and vent valves being open and the discharge valve closed. In this view the construction has been slightly modified to form the pump body as a unitary portion of the container closure cap and to adapt it for cooperation in such manner with a protective overcap as to provide an improved vent seal.

DETAILED DESCRIPTION OF THE INVENTION

Figure 1:
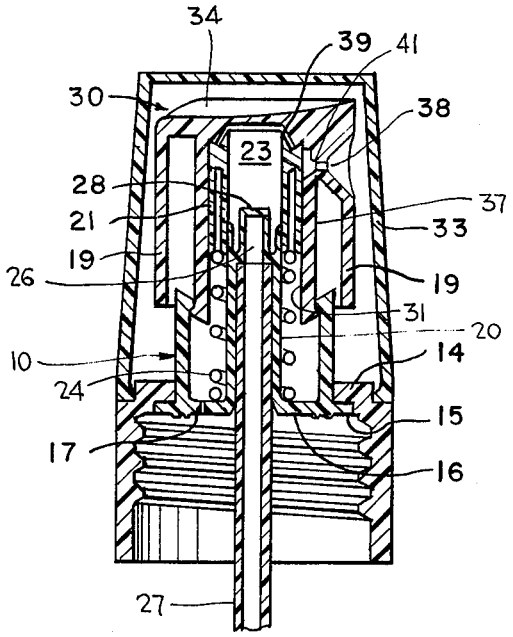
Figure 2:
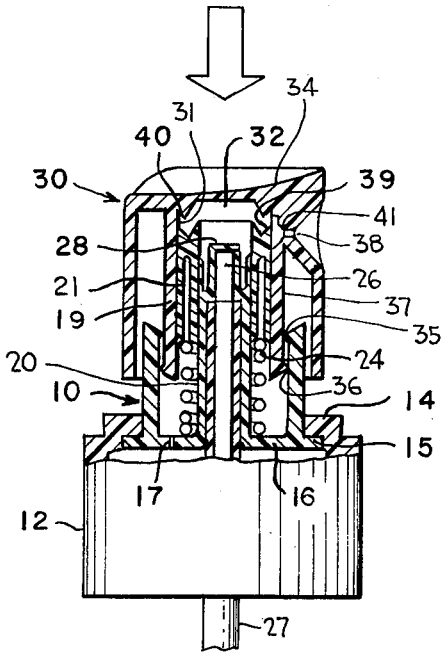

Referring now in detail to FIGS. 1 and 2 of the accompanying drawings, it will be seen by reference thereto that the invention comprises a generally cylindrical upwardly open ended pump body unit 10 adapted to be carried in fluid tight manner by a container closure cap 12 which may be internally threaded or otherwise arranged for securing it in liquid tight manner over the similarly threaded neck of a container, which is adapted to hold a flowable product to be dispensed by the pump.

The body 10 projects upwardly through an opening in the top wall 14 of the container cap and is provided at its base with an encircling ledge 15 to be clamped in normally fluid tight manner between the top wall of the cap and the upper end of the container neck. Formed through the bottom wall 16 of the body is a conventional vent or breather opening 17 to permit equalization of pressures within and outside of the container, and to permit return to the container of any flowable product which might leak or seep past the pump piston referred to hereinafter.

Affixed to and projecting axially upwardly from the bottom wall 16 of the body 10 is a stationary piston 20 for cooperation with an annular or tubular plunger unit 21 having an internal bore therethrough snugly slidably receiving and reciprocable on the stationary piston to therewith define a variable pump chamber 23. The piston illustrated is formed as a vertical standpipe.

A plunger spring 24 compressed between the bottom wall 16 of the body 10 and the tubular plunger 21 resiliently urges the latter upwardly toward its fully raised position and normally maintains it in that position.

It will be seen that the piston 20 is supported from and preferably integral with the annular base or bottom wall 16 of the body 10. Extending through the piston 20 and the bottom wall 16 of the body is an inlet passage 26 which preferably receives and is coupled to a conventional dip-tube 27 having its lower end (not shown) adapted to extend into the product to be dispensed from a container with which the pump is associated, all as is well known in the art.

A check valve 28, exemplified as a flap valve at the top of the hollow piston 20 in FIG. 1, permits free upward flow of flowable product from the container upwardly through the hollow piston 20 into the pump chamber 23 while preventing back flow of such product.

The plunger discharge head or unit 30 is formed to provide a downwardly directed blind socket 31 which snugly slidably receives the tubular plunger 21 and therewith defines an enclosed variable volume accumulation chamber 32 communicating through the tubular plunger with the valve controlled upper end of the inlet passage 26. This accumulation chamber 32 has an appreciably larger diameter than the pump chamber or cylinder, 23, and the annular upwardly presented end of the plunger is exposed to downward fluid pressure within the accumulation chamber in opposition to the upward thrust of the return spring 24.

As is illustrated in FIG. 1, a removable overcap 33 may be snap fitted or otherwise applied to the container cap and/or the body 10, over the upwardly projecting pump structure above described, to provide protection for same during shipping and storage. Also, if desired, and as illustrated in FIG. 1, the plunger head may be provided with a depending skirt or shroud 19 for concealing its telescopic connection with the body unit 10.

The plunger head 30 is conformed to present an upwardly directed finger piece 34 by which intermittent finger pressure may be conveniently applied to it to be transmitted to the tubular plunger 21 for producing reciprocation thereof on the stationary piston 20, it being noted that each depression of the plunger will be yieldably resisted by the spring 24 which will return the plunger to its fully raised position following each withdrawal of finger pressure.

Upward movement of the plunger head 30 is positively limited by suitable means such as the annular stop shoulders or ribs 35 and 36 respectively of the pump body 10 and the depending plunger head skirt 37. These sealingly engage each other in the raised plunger position of FIG. 1 to prevent communication between the vent opening 17 and the atmosphere during shipping and storage.

Opening from the plunger head socket 31 into the atmosphere is a discharge orifice adapted to convey the dispensed product from the accumulation chamber 32 to a suitable discharge point, preferably defined by a spray nozzle. The discharge orifice 38 opens into the socket 31 somewhat below the blind upper end thereof at a location such that its inner end is normally covered by the hollow plunger 21 when the latter is fully upwardly projected as in FIG. 1 into the blind end of the socket 31 by the spring 24.

At its upper end the plunger 21 preferably defines an upwardly directed annular skirt or groove 39 intersecting with the inner wall of the tubular plunger 21 and adapted for sealing engagement with the plunger head 30 at the blind upper end of its socket. With the plunger in its fully raised position, its sealing engagement with the blind end of the socket provides an efficient shipping seal for preventing flow of product to or through the discharge passage.

In this position, upward movement of the plunger head 30 will have been arrested by abutment between the stop shoulders 35 and 36 while spring 24 continues to thrust the tubular plunger upwardly, urging its skirt 39 into sealing engagement within the plunger head annular sealing rib 40, best shown in FIG. 2.

As above indicated the discharge orifice extends from the pressure accumulation chamber 32 and is located in the plunger head for discharging as in the manner of a conventional spray nozzle. In the illustrated embodiment, an spray nozzle includes a swirl chamber 41 formed in plunger head socket 31 and arranged concentrically to the discharge orifice. It will be noted that this swirl chamber is jointly defined by the plunger unit 21 and the plunger head unit 30 so that relative movement between the plunger and plunger head during operation of the pump tends to agitate and remove any coagulated or precipitated solids that might otherwise tend to accumulate within and clog the spray nozzle. Such accumulation of solids is further discouraged by the close proximity between the plunger and the discharge orifice, which allows but a minimum of space within which solids might tend to coagulate or accumulate. Because of this, the plunger functions in the manner of a so-called "tip-seal" for the nozzle.

MODE OF OPERATION

The mode of operation of the invention is as follows:

Assuming that the pump unit above described is applied to a container of product to be dispensed, the snap-on type protective overcap of FIG. 1, where employed, is first removed in obvious manner.

The pump is then actuated by intermittent finger pressure on the plunger head unit 30 to thus reciprocate the plunger unit 21 on the stationary piston 20. In accordance with usual practice the first reciprocation or reciprocations of the plunger unit 21 function to prime the pump by expelling the air therefrom and by drawing the flowable product upwardly through the diptube 27 and hollow piston 20 into the pump chamber 23, the pumping action being as hereinafter described both during the priming and product dispensing phases of the pump operation.

At the commencement of the priming and/or pumping operation, the various parts of the structure will be as illustrated in FIG. 1, wherein the pump spring 24 maintains the plunger in its fully raised position in sealing relation with the blind upper end of the socket defined by the plunger head unit, the head unit being held against upward displacement by the inter-engagement of the stop shoulders 35 and 36. Moreover the sealing engagement between these annular stop shoulders or ribs 35 and 36 prevents communication between the vent 17 and the atmosphere so as to prevent any leakage of liquid in the event the container and pump are inadvertently inverted.

On the initial downward stroke of the plunger head, its abutment with the upper end of the plunger will cause the latter to move downwardly on the stationary piston on a compression stroke, thereby compressing the spring 24. As the compression stroke continues, there will manifestly be a progressively increasing fluid pressure within the accumulation chamber 32 until such pressure creates a downward force on the plunger sufficient to overcome the resilient upward thrust of the pump spring 24. This will result in downward movement of the plunger within the plunger head socket sufficient to unseat the plunger from the blind upper end of the socket as in FIG. 2 and to uncover the end of the discharge passage 38, whereby the contents of the chamber 23 will be discharged under pressure through the discharge passage 38. Such discharge will continue as long as the pressure of fluid or product within the accumulation chamber is sufficient to maintain the plunger thus displaced downwardly with respect to the plunger head so as to maintain the discharge passage 38 uncovered.

Whenever the pressure within the accumulation chamber becomes insufficient to thus maintain the discharge passage open, either because of insufficient finger pressure on the plunger head or through discharge of the pump chamber and accumulation chamber contents near the end of the downstroke, the spring pressure will again reseat the plunger within the plunger head socket so as to close the discharge passage 38. As the finger pressure is released to permit the return stroke, the passage will remain in closed position to draw a new charge of product into the pump chamber as the plunger and plunger head are both restored to their normally raised position by the pump spring 24.

It will be noted that throughout the downward stroke of the plunger, and until it gains its fully raised position, the disengagement of the stop shoulders 35 and 36 will permit free communication of the container interior through the vent opening 17 with the atmosphere. Thus atmosphere air may flow readily into the container for the purpose of replacing discharged product.

As above indicated relative movement of the plunger and plunger head incident to operation of the pump will automatically produce a wiping and agitating action on the product within the swirl chamber so as to discourage accumulation or formation of solids which might clog the latter.

It will be noted that the preferred form of pump is located outside of the container on which it is to be mounted, except as to the dip-tube itself. This permits use of the pump on quite small containers with openings only of a sufficiently large size to receive the dip-tube. Notwithstanding this, the pump of the present invention can be readily scaled up for use in high volume dispensing operations such as may be desirable for household and laundry type products.

With the exception of the dip-tube and plunger spring, it will be apparent that the pump of the invention incorporates but three major components or units all of which are movable with respect to each other, for achieving the necessary pumping and discharge pressure controls, as well as the valving and venting functions. The pumping action, including actuation of the inlet check valve, is achieved by reciprocation of the plunger unit with respect to the pump body with its included piston, and control of the venting action is similarly responsive to the relative positions of these units. Control of the outlet valving function is achieved through relative movement between the plunger and the plunger head units in response to changes in fluid pressure within the pressure or accumulation chamber jointly defined by these units, the plunger itself acting as the outlet valve and eliminating need for usual check valves of a more conventional nature.

Because of the small number of unitary parts of the pump herein disclosed, it will readily be apparent that same is capable of quite economical production and assembly while nevertheless being quite reliable and efficient in its operation.

Figure 3:
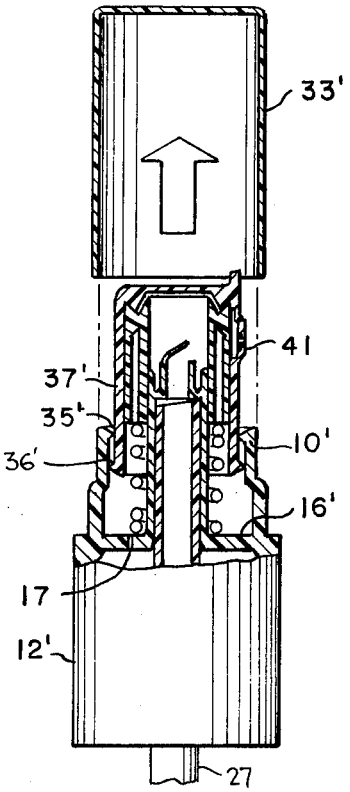

In the modified embodiment of the invention illustrated in FIG. 3, the several components, their mode of cooperation and assembly are similar to those hereinbefore described, the parts in this view being illustrated at approximately the mid-point of the upward or suction stroke of the plunger in which the outlet valve defined by the plunger in cooperation with the plunger head is closed while the inlet valve is open. Here as in the preferred embodiment, the inlet valve is of the flap type, formed integrally with the upper end of the piston and attached thereto by a flexible connection functioning in the manner of a hinge. Such hinges are well known in the plastics fabrication art.

FIG. 3 illustrates how the pump body 10′ may be formed as an integral portion of the container cap 12′, so that the top wall of the cap also constitutes the annular bottom wall 16 of the pump body.

In addition, the portion 10′ of the body which telescopically receives the overcap 33′ is molded or fabricated of a resiliently deformable plastic or other material of a normal external diameter which is so related to the internal diameter of the protective overcap 33′ as to form a jam fit therewith when the overcap and body are in telescoping assembled relation, all to the end that the resulting confining and slight radial inward deflection of the upper free end of the body portion or sleeve 10′ will urge its internal annular stop-rib 35' into snug sealing engagement the depending plunger head skirt 37' around the entire periphery thereof. Thus there is achieved an improved shipping seal supplementing the action of the stop shoulders 35' and 36' in positively preventing leakage or seepage of liquid product which might have entered the space enclosed by the interrelated telescoping members 10' and 37'.

Figure 4:
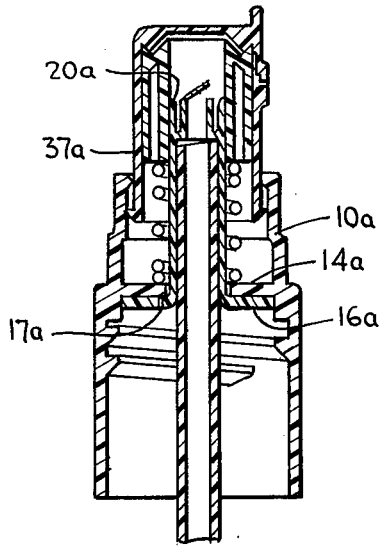
FIG. 4 is a view similar to FIG. 3 of a still further embodiment of the invention incorporating a positively actuated venting valve.
Figure 5:
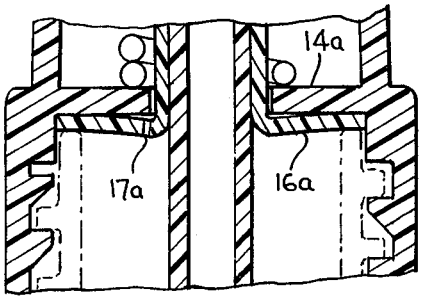
FIG. 5 is an enlarged fragmentary sectional view showing the venting valve in its open position.

In the embodiment of FIGS. 4 and 5, the construction and arrangement are substantially the same as in FIG. 3, except that the parts have been somewhat modified to provide a venting valve which is positively actuated by and in response to intermittent finger pressure applied to the plunger head. To this end, the sleeve or body portion **10*a***, which telescopically cooperates with the plunger head skirt is formed integrally with the container cap rather than as an integral part of the pump body as in preceeding embodiments.

The pump body on the other hand includes an annular base **16*a* to which the stationary pump piston 20*a* is integrally affixed. In this instance, the base 16*a* constitutes an annular gasket of resiliently flexible plastic or other material of which the hollow or tubular piston constitutes an integral portion as heretofore. The said gasket is disposed beneath and adjacent the top wall 14*a*** of the container cap so that when the cap is threaded on or otherwise applied to the neck of a product container, the outer marginal edge portion of the gasket is clamped in fluid tight manner between the top wall and the container neck, then projects upwardly with substantial clearance through the central aperture of the closure cap top wall.

It will be seen that the inner-marginal area of the flexible gasket **16*a* immediately surrounding and adjacent the piston 20*a* when in its normal unstressed condition, is in fluid tight engagement with the top wall 14*a* of the cap to thus close the vent port 17*a* formed in the inner-peripheral area of the gasket closely adjacent the outer wall of the piston 20*a***.

Thus the inner-marginal area of the flexible gasket **16*a* is capable of flexing as shown in FIG. 5 away from the top wall 14*a* of the container cap, responsive to downward pumping pressure on the piston 20*a*. Thus, in operation of the pump, atmospheric air entering the space enclosed by the telescopically related skirts 10*a* and 37*a* may flow through the clearance space between the central aperture of the closure cap top wall and the piston 20*a* to thus pass inwardly through the port 17*a*** to the product container, admitting air at atmospheric pressure into the container to which the pump is applied.

Having thus described my invention, I claim:

1. A dispensing pump of the pressure accumulating type comprising a pump body and means for securing same in fluid tight communication with the opening of a container of flowable product to be dispensed;

said body including an annular base and a piston affixed to and projecting upwardly therefrom;

an annular plunger mounted for reciprocation on said piston to therewith define a variable volume pump chamber;

a plunger spring for urging said plunger upwardly toward a fully raised position above the base;

said piston and said base having a check valve controlled inlet passage therethrough for establishing communication between said pump chamber and a container of flowable product to be dispensed;

a plunger head having a downwardly directed blind socket slidably disposed on said annular plunger and therewith defining a variable volume accumulation chamber between said annular plunger and the blind end of said socket, and communicating freely with the pump chamber;

said plunger head being formed with a discharge passage extending therethrough from said socket to the atmosphere at a location to be opened and closed by relative movement between said plunger head and said plunger in the direction of said reciprocation;

and means for arresting the upward movement of the plunger head at a predetermined position wherein said spring normally urges the said plunger fully into the said socket to function as a valve for closing said passage.

2. The combination of claim 1, wherein a vent opening is formed through said annular base of the body to return to the container any product escaping by seepage from the pump chamber past the said stationary piston.

3. A pressure accumulating dispensing pump as defined in claim 2, in which said means for securing the pump body in fluid tight communication with the opening of a container comprises a container cap having a centrally apertured top wall and a depending skirt therearoung for connection to a container neck;

said base being of resiliently flexible material to function as an annular gasket disposed beneath and adjacent said top wall for clamping of its outer marginal portion between said top wall and the container to which said cap is secured;

said piston being integrally secured to said base concentrically to the inner periphery thereof and projecting upwardly through said centrially apertured top wall of the cap;

said vent opening extending through the inner marginal area of said base closely adjacent to said piston, said base in its normally unstressed condition being in fluid tight engagement with said top wall of said cap to close said vent opening;

the inner marginal area being capable of flexing away from said top wall responsive to downward pumping pressure on said piston to open said vent opening.

4. The combination of claim 1, in which said plunger head and said body are provided with relatively telescoping cylindrical portions having annular stop shoulders associated therewith for arresting the upward movement of the plunger head in said predetermined position.

5. The combination of claim 4, in which said stop shoulders sealingly engage each other and cooperate with said telescoping portions, said plunger head and said plunger to therewith define a fluid tight housing when said stop shoulders are sealingly engaged, said body being formed with an opening therethrough for maintaining communication between the interior of the said telescoping portions and the interior of a container to which the pump is applied.

6. The combination of claim 5, in which said body includes an upwardly directed stand-pipe adapted for communication at its lower end with the container, said piston constituting a unitary part of said stand-pipe adjacent its upper end, said piston and stand-pipe being concentric to and radially spaced from said telescoping portions, and the inlet passage extending upwardly through the upper end of said piston into the pump chamber.

7. The combination of claim 6, in which said spring is in the form of a coil concentrically encircling the said stand-pipe and piston, its upper end abutting against the lower end of said tubular plunger to urge the latter upwardly in said socket, said plunger isolating the spring from said pump chamber and said expansion chamber.

8. The combination of claim 1, wherein all parts of said pump are located above and exteriorly of a container to which said pump is applied.

9. The combination of claim 1, in which said discharge passage is defined in part by a swirl chamber in the form of a depression on the inner wall of said plunger head socket and communicates with a discharge orifice opening through said wall into the atmosphere, the inner axial end of said swirl chamber being defined by the radially outer wall of the said tubular plunger, whereby movement of the plunger will discourage formation of solids within the swirl chamber and orifice.

10. The combination of claim 1, in which said plunger head includes a cylindrical skirt extending into and telescopically associated with said body, said body being formed with a radially inwardly projecting annular stop shoulder and said telescopically related skirt of the plunger head being encircled by a radially outwardly projecting annular stop shoulder for abutting engagement with said stop shoulder of the body, said body in the region of its said annular stop shoulder being composed of resiliently deformable material, in combination with an overcap adapted for movable reception over said plunger head, with its lower end snugly frictionally encircling and received on said body and proportioned to radially inwardly deform said body and its said stop shoulder to bring the latter into snug sealing engagement with the exterior cylindrical surface of said depending plunger head skirt.

11. A pressure accumulating dispensing pump as defined in claim 1, in which an inlet check valve is operatively carried by the piston at the upper end of said piston.

12. The combination of claim 11, in which said inlet check valve is in the form of a flap valve integrally hingedly connected to the said piston.

* * * * *